United States Patent [19]

Carter et al.

[11] 4,295,077

[45] Oct. 13, 1981

[54] CIRCUMFERENTIALLY APERTURED CYLINDRICAL GRID FOR ELECTRON TUBE

[75] Inventors: Don R. Carter, Lancaster; Claude E. Doner, New Providence; Fred G. Hammersand, East Petersburg; Joseph R. Tomcavage, Lancaster, all of Pa.

[73] Assignee: RCA Corporation, New York, N.Y.

[21] Appl. No.: 121,530

[22] Filed: Feb. 14, 1980

[51] Int. Cl.[3] ..... H01J 1/46; H01J 21/10

[52] U.S. Cl. ..... 313/293; 313/297; 313/299; 313/348

[58] Field of Search ..... 313/293, 297, 299, 348

[56] References Cited

U.S. PATENT DOCUMENTS

| | | | |
|---|---|---|---|
| 1,437,607 | 12/1922 | Mueller | 315/35 |
| 1,670,503 | 5/1928 | Greenbowe | 313/348 X |
| 1,674,331 | 6/1928 | Jackman | 313/348 X |
| 2,980,984 | 4/1961 | Shrader et al. | 313/348 X |
| 3,249,791 | 5/1966 | Kendall, Jr. | 313/293 |
| 3,305,748 | 2/1967 | Pehe et al. | 313/348 |
| 3,337,933 | 8/1967 | Seiffarth et al. | 313/299 X |

*Primary Examiner*—Saxfield Chatmon, Jr.

*Attorney, Agent, or Firm*—Eugene M. Whitacre; Dennis H. Irlbeck; Vincent J. Coughlin, Jr.

[57] ABSTRACT

An improved high power electron tube has at least one grid electrode. The grid electrode is formed from a one piece cylindrical member, closed at one end, having an outside diameter, D. The cylindrical member has a plurality of arcuate, circumferentially elongated apertures extending therethrough. Each of the apertures has a length x and a width y wherein the length x is greater than width y, and wherein the length x is not greater than 0.55 times the diameter, D, of the electrode. The width y, of each of the apertures is not greater than 0.1 times the diameter D, of the electrode.

7 Claims, 2 Drawing Figures

CIRCUMFERENTIALLY APERTURED CYLINDRICAL GRID FOR ELECTRON TUBE

BACKGROUND OF THE INVENTION

The present invention relates to a high power electron tube and particularly to an improved grid structure for such a tube.

A high-power electron tube such as the RCA 8916 VHF linear power amplifier tube may be used in high gain, high linearity equipments for VHF-TV and FM service and for communication transmitters to 400 MHz. The terminals of such a power tube are coaxial for operation in a normal coaxial TEM mode. In the operation of such a power tube there are an infinite number of spurious resonant modes, such as the TE and TM modes, that may exist simultaneously within a resonant cavity or system along with the desired TEM mode. In a typical power tube the spurious resonances occur at frequencies that are generally much higher than the desired operating frequency of the tube and thus cause no problems because little or no power can be generated in the tube at these frequencies. However, there are generally a few spurious modes that do pose problems and these problems are manifested as rf oscillations at the spurious mode frequencies. These rf oscillations are detrimental to tube performance in that they can increase any of the following tube operating parameters: peak operating voltage; unit area electrode dissipation; dielectric losses; noise on signal; and rf leakage; as well as generate interference signals, and reduce circuit operating efficiency. In some instances tube failures have been reported due to cracks in ceramic insulators attributable to the aforementioned rf oscillations.

For the detrimental effects of the spurious rf oscillations to occur there must be rf feedback from an output circuit comprising the anode and associated electrodes to an input circuit comprising the control grid and associated electrodes of such a magnitude and phase to overcome any inherent circuit losses. If these conditions are fulfilled, the strength of the spurious oscillations will increase until the spurious losses equal the power generated at the spurious frequencies. It has been determined that rf feedback is dictated by such factors as grid aperture length, grid thickness and aperture orientation.

Attempts to eliminate the causes of these undesirable rf oscillations have been largely unsuccessful and instead efforts are generally made to attenuate spurious oscillations, at least to a level wherein the amplitudes are small compared to the desired operating frequency. For example, contemporary power tube circuits generally oscillate at frequencies that are associated with the TE or TM circular modes. Typically these modes inherently have low loss characteristics and attempts to provide significant circular mode loading are often frustrated by the inability to achieve circular mode loading without reducing circuit efficiency at the desired operating frequency.

Since it is difficult to specifically load the spurious circular modes without degrading the designed amplifier characteristics of the tube, it becomes attractive to prevent or control the onset of spurious oscillations by reactively attentuating the spurious rf feedback.

SUMMARY OF THE INVENTION

An improved high power electron tube includes a cylindrical grid electrode having an array of apertures therein. Each of the apertures is circumferentially elongated with the elongated dimension being not greater than 0.55 times the diameter of the grid.

DETAILED DESCRIPTION OF THE PREFERRED EMBODIMENT

Figure 1:
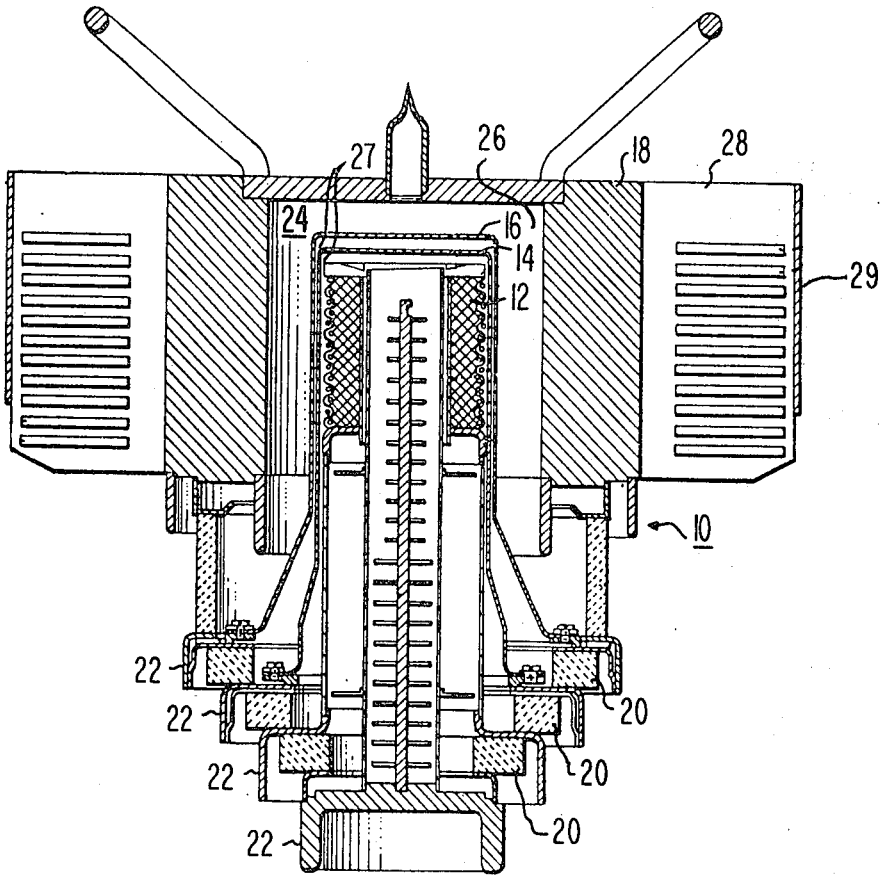
FIG. 1 is a longitudinal cross-sectional view of a high power electron tube employing the present grid structure.

With initial reference to FIG. 1, a high power electron tube, generally designated 10, comprises a cathode 12, a control grid 14, a screen grid 16, and an anode 18. These tube elements are all cylindrical and are in coaxial, nested, non-abutting relationship with one another. One end of each of the coaxial elements are spaced from one another by insulated ceramic rings 20 and include terminal areas 22. The cylindrical anode 18 forms a portion of the envelope of the tube 10. The region between the anode 18 and the cathode 12 forms a resonant system 24. In a tetrode, as shown in FIG. 1, the resonant system 24 comprises an output resonator 26 and an input resonator 27. The output resonator 26 includes the volume between the anode 18 and the screen grid 16. The input resonator 27 includes the volume between the screen grid 16, the control grid 14 and the cathode 12. Extending radially from the exterior of the anode 18 are a plurality of spaced heat fins 28. Extending around the exterior edge of the heat fin array is a cylindrical sleeve 29.

The arrangement thus far described is conventional. The present novelty resides in the provision of a plurality or arcuate, circumferentially elongated apertures 30 and 32 formed in the control grid 14 and the screen grid 16, respectively.

Figure 2:
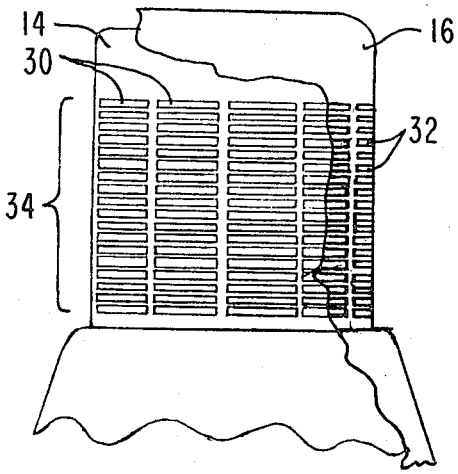
FIG. 2 is an enlarged partial cut-away view of the grid structure shown in FIG. 1.

As shown in FIG. 2, the grid structure comprises the control grid 14 and the screen grid 16, both of which are tubular or cylindrical. Each of the grids 14 and 16, respectively, are formed from a rigid, hollow, one piece cylindrical member, closed at one end. The grids 14 and 16 may be made from thin walled material currently used for similar purposes. The circumferentially elongated apertures 30 and 32 have a length x and a width y wherein the length x is greater than the width y. Each of the apertures 32 of the screen grid 16 are radially aligned with a corresponding one of the apertures 30 of the control grid 14. The appertures 30 and 32 may be formed by electrical discharge machining as described in U.S. Pat. No. 2,980,984 to M. B. Shrader et al., issued on Apr. 25, 1961, entitled "Art of Fabricating Electron Tubes", and incorporated by reference herein. If electrical discharge machining is used to form the apertures 30 and 32, and entire longitudinal column of apertures may be formed in a single step.

It has been determined by operational tests that excitation of the undesirable spurious TM and TE modes, referred to herein as circular modes, which are not uncommon in power tubes operating in the TEM mode and having longitudinally extending grid apertures, has been substantially attenuated or eliminated in tubes such as the RCA 8916 VHF Linear Power Amplifier by changing the orientation and length of the grid apertures as described herein. As a general rule, for control grids having an outside diameter, D, the circumferential elongated dimension or length x of the apertures should not be greater than 0.55 times the diameter D, and the width y of the apertures should not be greater than 0.1 times the diameter D.

An electron tube having a cylindrical grid with circumferentially extending apertures is described in U.S. Pat. No. 1,437,607 to Mueller, issued on Dec. 5, 1922, entitled, "Electron Tube". The Mueller patent, however, does not teach or suggest that spurious TE or TM modes can be prevented or controlled by restricting the circumferential dimension of the grid apertures as described herein. In fact, the Mueller tube structure is essentially an open structure, i.e., the grid structure and the anode are open ended, and the structure does not have coaxial terminals thus no spurious circular mode oscillations are expected in such a structure. Thus the Mueller patent cannot be viewed as a teaching reference for applicants' claimed structure which controls spurious oscillations.

Recently a tube embodying the present invention was constructed and operationally tested as mentioned above. By way of example, the control grid 14 of the tube 10 had an inside diameter of 1.485 inches and an outside diameter of 1.545 inches. A plurality of elongated apertures 30 each having a length of 0.45 inches and a width of 0.065 inches extended along the circumference of the control grid 14. The screen grid 16 which was coaxially disposed around the control grid 14 had an inside diameter of 1.605 inches and an outside diameter of 1.665 inches. A plurality of elongated screen grid apertures 32 having a length of 0.45 inches and a width of 0.065 inches were radially aligned with the control grid apertures 30. A total of ten longitudinal columns of apertures were equally spaced around each of the grids 14 and 16. Eighteen circumferential rows of apertures completed the aperture array.

An electron interaction region 34, defined as the total longitudinal column height of the grid apertures, as shown in FIG. 2, extends for about 1.40 inches along the control grid 14 and the screen grid 16. The aforementioned aperture dimensions assure that rf coupling to the circular modes is significantly attenuated and that spurious oscillations at the circular mode resonances do not occur.

While the present structure increases the possibility of spurious TEM oscillations, such oscillations are unlikely since the length of the aforementioned interaction region 34 is much less than a half wavelength at the operating TEM frequency. It is well known in the art that for spurious oscillations to occur, the length of the interaction region must be significant in relation to a half wavelength at the operating TEM frequency. In addition, the length of the interaction region 34 is considerably less than the circumference of the grids 14 and 16 and hence there is less chance for feedback in the TEM mode using the present structure than for circular mode feedback using the conventional longitudinal grid structure.

Limiting the circumferential dimension of each of the apertures 30 and 32 in the present grid structure as described above, minimizes the circular mode excitation that can be developed in the output resonator 26 and fed back to the input resonator 27 thus greatly inhibiting the onset of circular mode oscillations. The above-described novel grid structure takes advantage of the fact that spurious TEM modes are more easily loaded with circuit couplers normally used for the designated operating modes. Hence, the Q, of the resonant system 24, defined as the ratio of the time averaged energy stored in the resonant system to the energy loss per cycle, of spurious TEM modes is much lower than that of the spurious circular modes in the same frequency range. Furthermore, since it is impossible to fabricate tubes and resonant systems with ideal symmetry, some energy is transferred from TEM modes to circular modes thus providing an additional loading machanism for TEM modes thereby reducing the feedback which could cause spurious rf oscillations.

While the tube 10 has been described as having a grid aperture array comprising ten columns and eighteen rows, it should be clear to one skilled in the art that the number of columns and rows can be varied from the above-described example.

What is claimed is:

1. In a high power electron tube having a cathode, a cylindrical anode circumscribing said cathode and at least one tubular electrode disposed between said cathode and said anode, said electrode being formed from a cylindrical member closed at one end, said member having an outside diameter D, said member further having a plurality of first apertures extending therethrough, each of said first apertures having a length x and a width y, the improvement wherein said electrode comprises:

spurious oscillation control means including said first apertures, wherein said first apertures are circumferentially elongated, the length x, of said first apertures being greater than the width y, and wherein the length x of said first apertures is not greater than 0.55 times the diameter D, of said one electrode.

2. The tube as in claim 1 wherein said first apertures are aligned to form a plurality of circumferential rows and longitudinal columns.

3. The tube as in claim 1 further including a second tubular electrode in spaced, coaxial, nested, nonabutting, insulated relationship with said one tubular electrode, said second electrode being formed from a cylindrical member having a plurality of arcuate, second apertures radially aligned with said first apertures of said one electrode.

4. The tube as in claim 3 wherein said second electrode is disposed between said one electrode and said anode.

5. The tube as in claim 1 wherein the width, y, of said first apertures is not greater than 0.1 times the diameter D, of said one electrode.

6. In a high power electron tube having a cathode, an anode and at least one tubular electrode disposed between said cathode and said anode, said tubular electrode being closed at one end and having a plurality of apertures extending through the tubular portion thereof, the improvement comprising the apertures in said tubular electrode being circumferentially elongated, the length of said apertures being not greater than 0.55 times the diameter of said tubular electrode whereby spurious oscillations are controlled.

7. The tube as defined in claim 6 including a second tubular electrode nested in spaced relationship with said one tubular electrode, said second tubular electrode having elongated apertures aligned with the apertures in said one tubular electrode.

* * * * *